United States Patent [19]

Meek

[11] Patent Number: 4,597,439

[45] Date of Patent: Jul. 1, 1986

[54] FULL-BORE SAMPLE-COLLECTING APPARATUS

[75] Inventor: Dale E. Meek, Missouri City, Tex.

[73] Assignee: Schlumberger Technology Corporation, Houston, Tex.

[21] Appl. No.: 759,631

[22] Filed: Jul. 26, 1985

[51] Int. Cl.[4] ..... E21B 49/08

[52] U.S. Cl. ..... 166/163; 166/164; 166/169; 166/264; 166/319; 166/332

[58] Field of Search ..... 166/264, 250, 162, 165, 166/169, 332, 334, 374, 386, 142, 188, 163, 164, 319; 73/151

[56] References Cited

U.S. PATENT DOCUMENTS

| | | | |
|---|---|---|---|
| Re. 29,638 | 5/1978 | Nutter | 73/151 |
| 3,308,887 | 3/1967 | Nutter | 166/150 |
| 3,358,755 | 12/1967 | Chisholm | 166/264 |
| 3,456,726 | 7/1969 | Barrington et al. | 166/162 |
| 3,796,261 | 3/1974 | Nutter | 166/334 |
| 3,823,773 | 7/1974 | Nutter | 166/250 |
| 3,969,937 | 7/1976 | Barrington et al. | 166/264 |
| 4,502,537 | 3/1985 | Carter, Jr. | 166/264 |

*Primary Examiner*—James A. Leppink
*Assistant Examiner*—Hoang C. Dang

[57] ABSTRACT

In the representative embodiments of the new and improved apparatus disclosed herein, a string of full-bore well tools are arranged to be suspended from a pipe string in a well bore penetrating an earth formation in flow communication with the well bore. A full-bore packer coupled to the pipe string is operated from the surface for isolating the well bore interval below the packer from the fluids in the well bore thereabove. To test the formation, a test valve coupled to the pipe string is selectively operated from the surface for opening the pipe string to the flow of formation fluids from the isolated well bore interval. Thereafter, when it is desired to obtain a sample of the formation fluids flowing in the pipe string, the new and improved full-bore sample-collecting apparatus coupled to the pipe string is selectively operated from the surface to admit the fluids in the pipe string into an annular sample chamber within the new and improved apparatus. The sample collecting apparatus is further operable only in response to the admission of formation fluids into the sample chamber to regulate the flow rate at which these fluids are admitted into the sample chamber so as to not disturb the fluid sample any more than is necessary. Thereafter, this apparatus operates only in response to filling of the sample chamber for trapping the fluid sample.

16 Claims, 8 Drawing Figures

FULL-BORE SAMPLE-COLLECTING APPARATUS

BACKGROUND OF THE INVENTION

This invention relates to well bore apparatus; and, more particularly, this invention pertains to full-bore fluid-collecting tools for obtaining representative samples of formation fluids produced during drillstem tests in both cased and uncased well bores.

BACKGROUND ART

It is customary to conduct so-called drillstem tests in uncased boreholes as well as in cased well bores having one or more perforated intervals providing communication with adjacent formation intervals. In either case, a number of different full-bore tools is dependently coupled from a pipe string suspended in the well. These tools typically include a full-bore packer which is selectively set at a convenient location in the borehole or well bore for packing-off or isolating the formation interval which is to be tested from the hydrostatic pressure imposed by a well-control fluid such as a typical drilling mud. Thereafter, a normally-closed valve in a suitable test tool in the tool string is operated to alternately open and close communication between the pipe string and the isolated formation. In this manner, should there be producible formation fluids within the selected interval, opening of the test tool will allow the formation fluids to flow to the surface by way of the several tools and the pipe string. By means of suitable pressure recorders in the string of tools, a series of useful pressure measurements are recorded during the course of the test. Moreover, a suitable sample-collecting tool is usually included in the tool string to collect a representative sample of the formation fluids produced during the testing operation.

Those skilled in the art recognize, of course, that heretofore such sample-collecting tools have not been entirely satisfactory for various reasons. For instance, with many prior-art sample-collecting tools, a sample entering the tool must pass through one or more restricted or tortuous flow passages to enter the sample chamber of the tool. Arrangements such as this make it difficult, if not impossible, to collect a representative sample without subjecting the flowing fluids to extreme changes in the pressure of the sample as it is being collected. It will be appreciated, of course, that many of these prior-art samplers do not provide substantially-unobstructed access through the sampler to other tools below the sample-collecting tool.

OBJECTS OF THE INVENTION

Accordingly, it is an object of the present invention to provide a new and improved full-bore fluid-sampling tool which may be selectively operated from the surface for collecting a representative sample of formation fluids during an otherwise-typical drillstem test.

SUMMARY OF THE INVENTION

These and other objects of the present invention are attained by telescopically arranging inner and outer tubular members for selective movement between longitudinally-spaced operating positions. Means are cooperatively arranged for defining an annular sample chamber between the inner and outer members. Means selectively operable from the surface are provided for admitting formation fluids into the sample chamber in one of the operating positions of the members. Means responsive to the pressure of these formation fluids are cooperatively arranged for regulating the entrance of the fluids into the sample chamber to at least minimize unwanted changes in the state or condition of these connate fluids. Additional means responsive to the pressure of these connate fluids are also provided for subsequently shifting the telescoped members to their other operating position only upon filling of the sample chamber and thereby closing fluid communication with the chamber.

BRIEF DESCRIPTION OF THE DRAWINGS

The novel features of the present invention are set forth with particularity in the appended claims. The operation, together with further objects and advantages thereof, may best be understood by way of illustration of certain embodiments when taken in conjunction with the accompanying drawings, in which:

DESCRIPTION OF A PREFERRED EMBODIMENT

Figure 1:
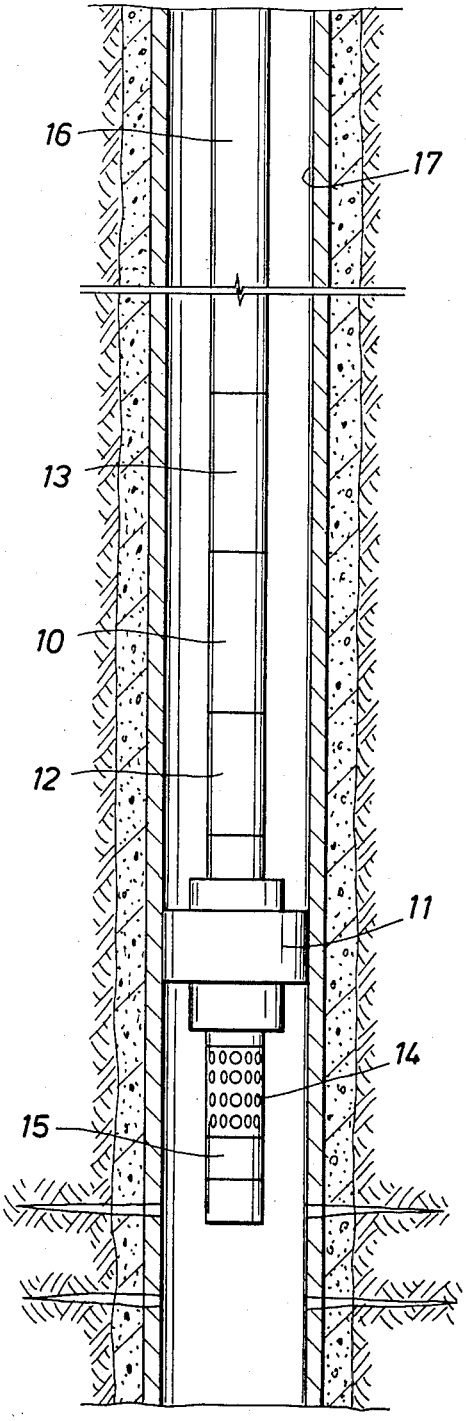
FIG. 1 shows a string of full-bore well tools such as may be typically used in a cased well bore and including a full-bore sample-collecting tool of the present invention.

Turning now to FIG. 1, a fluid sampler 10 of the present invention and a number of typical full-bore well tools 11–15 are shown tandemly connected to one another and dependently coupled from the lower end of a string of pipe such as a tubing string 16. Although the new and improved tool 10 can be used with equal success for collecting a fluid sample during a typical drillstem test in an uncased borehole, the sampler and the other tools 11–15 are illustrated and will subsequently be described as they will customarily be arranged to conduct a drillstem test in a cased well bore as at 17. The other tools 11–15 include a conventional full-bore packer 11 which is cooperatively arranged to be positioned at a convenient location in the cased well bore 17 and operated as necessary for packing-off the well bore to isolate a particular perforated interval therebelow which is to be tested by successively opening and closing a typical tester 12 included in the string of tools. As is typical for testing cased holes, it is preferred that the test valve 12 be arranged to be selectively opened and closed in response to controlled increases in the pressure of the drilling mud in the annulus of the well bore 17 above the packer 11. A typical test valve of this nature is shown in U.S. Pat. No. Re. 29,638. A reversing valve 13 may also be included in the string of tools. A perforated tail pipe 14 may be dependently coupled to the packer 11 to permit fluids in the isolated interval to enter the string of tools. One or more pressure recorders (not seen) may also be enclosed in a suitable housing 15 that is coupled to the tail pipe 14 for acquiring a record of the pressure variations in the isolated portion of the well bore 17 during the drillstem-testing operation. Depending upon the nature of the testing operation and the condition of the well bore 17, those skilled in the art might also choose to employ additional tools such as a jar and a safety joint (neither shown).

Turning now to FIGS. 2A–2D, successive, partially cross-sectioned elevational views are shown of a preferred embodiment of the new and improved fluid sampler 10 of the present invention as it will customarily be arranged for operation in cased well bores as at 17. Those skilled in the art will, of course, recognize the various typical design details may be employed to fashion a tool of this nature. Accordingly, to facilitate the following description of the sampler 10, some typical constructional details of a minor nature have been somewhat simplified in the accompanying drawings where possible to do so without affecting the full and complete disclosure of the present invention.

The new and improved fluid sampler 10 of the present invention includes upper and lower tubular members or mandrels 18 and 19 telescopically disposed within an elongated, outer housing 20 which, as will subsequently be explained, is best arranged as tandemly-coupled tubular sections 21–23. The upper and lower mandrels 18 and 19 are operatively arranged within the housing 20 to be independently moved therein between their respective initial or so-called "running-in" positions (as illustrated in FIGS. 2A–2D and 3) and their respective final positions (as will subsequently be described by reference to FIGS. 4 and 5).

As illustrated in FIGS. 2A–2D, the fluid sampler 10 further includes upper and lower annular chambers 24 and 25 which are respectively defined between the upper and lower housing sections 21 and 23 and the upper and lower mandrels 18 and 19. Pressure-responsive means, such as a piston member 26 on the mandrel 19, are cooperatively arranged for selectively moving the lower mandrel upwardly to its final position whenever a representative sample of formation fluids is to be collected. Additional pressure-responsive means, such as a piston member 27 on the mandrel 18, are also uniquely arranged for subsequently moving the upper mandrel to its final position so as to trap a fluid sample in the upper chamber 24 only after the sample has been collected.

Upper and lower mandrel-retaining means 28 and 29 are arranged in the upper and lower housings 21 and 23 respectively for releasably securing the upper and lower mandrels 18 and 19 in their illustrated running-in positions while the sampler 10 is being positioned in the well bore 17. As will subsequently be explained, once the tool 10 has returned to the surface and the collected fluid sample has been removed for examination, the mandrel-retaining means 28 and 29 are further useful to be operated manually for conveniently returning the upper and lower mandrels 18 and 19 to their respective running-in positions while the tool 10 is at the surface and without having to completely disassemble the tool.

Figure 2A:
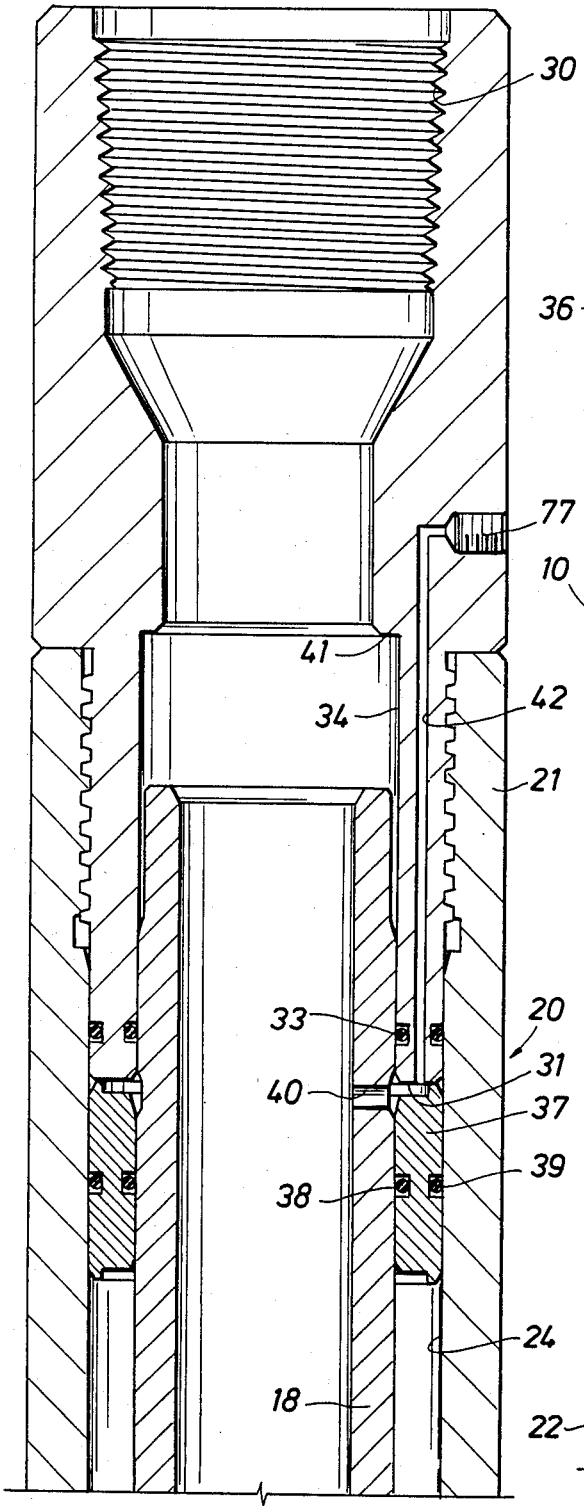
FIGS. 2A–2D are successive elevational views, partially in cross-section, of a preferred embodiment of a new and improved well tool incorporating the principles of the present invention.
Figure 2B:
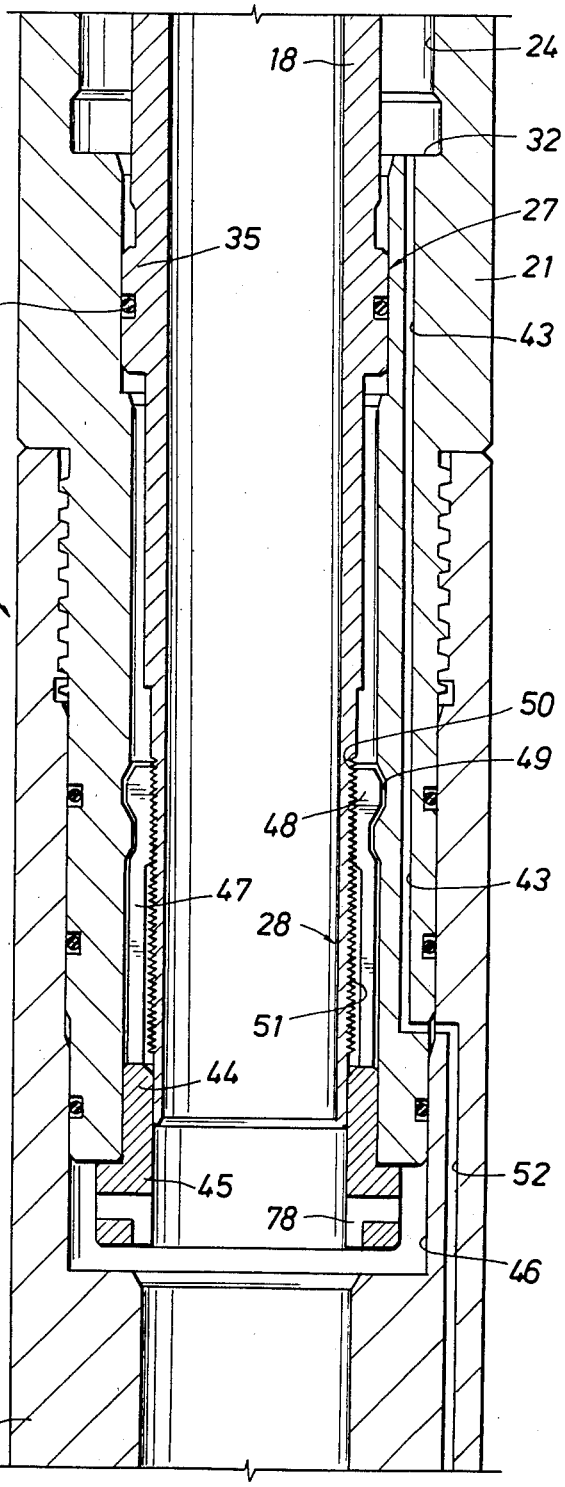

Turning now to FIGS. 2A and 2B, the uppermost portion of a preferred embodiment of the new and improved sampler 10 is depicted as its several components respectively appear when the fluid sampler is in its initial running-in position. As seen, the upper end of the upper housing 21 is appropriately provided with internal threads 30 for dependently coupling the sampler 10 to other tools thereabove. To collect samples of significant volume, the upper annual chamber 24 is preferably enlarged, with the opposite ends of the enlarged chamber defining opposing shoulders 31 and 32. As will subsequently be explained by reference to FIGS. 3–5, the upper portion of the upper mandrel 18 is fluidly sealed in relation to the housing 21 by means such as an O-ring 33 mounted within the axial bore 34 of the housing just above the annular chamber 24. The piston member 27 is preferably arranged by enlarging the intermediate portion of the upper mandrel 18 and fluidly sealing this enlarged portion in relation to the housing 21 by means such as an O-ring 36 on the enlarged mandrel portion.

An annular piston member 37 is cooperatively arranged within the upper annular chamber 24 for longitudinal movement between the opposed shoulders 31 and 32, with the piston member being fluidly sealed in relation to the upper mandrel 18 and the upper housing 21 respectively by means such as inner and outer O-rings 38 and 39 on the annular piston. In the preferred manner of selectively controlling fluid communication with the sample chamber 24, a sample passage such as a lateral port 40 is appropriately located in the upper wall of the mandrel 18 so as to be situated below the O-ring 33 whenever the upper mandrel is in its lower or running-in position. The lateral port 40 is also located so that it will be shifted above the O-ring 33 whenever the upper mandrel 18 is moved upwardly from its initial running-in position to its ultimate elevated position within the housing 21. Although other stop means can be employed, the elevated position of the upper mandrel 18 is preferably determined by appropriately locating a downwardly-facing shoulder 41 in the housing bore 34 above the chamber 24. For reasons that will subsequently be discussed, upper and lower longitudinal passages 42 and 43 are respectively arranged in the wall of the upper housing 21 to provide communication with the upper and lower ends of the enlarged annular chamber 24.

Turning now to FIG. 2B, it will be seen that the upper mandrel-retaining means 28 include a tubular member 44 which is rotatably mounted within the lower portion of the axial bore in the upper housing and is provided with an enlarged lower end portion 45 which is loosely confined within an enlarged annular space 46 defined between the upper and intermediate housings 21 and 22. The reduced-diameter upper portion of the tubular member 44 is longitudinally slotted at circumferentially-spaced intervals to define a plurality of upwardly-extending flexible fingers, as at 47, with outwardly-enlarged head portions, as at 48, adapted to be complementally received in a circumferential groove 49 formed in the adjacent interior wall of the housing 21. The enlarged heads 48 are internally threaded, as at 50, and threadedly engaged with external threads, as at 51, along the lower end portion of the upper mandrel 18. It should be noted that the overall length of the external mandrel threads 51 is somewhat greater than the maximum span of longitudinal travel of the upper mandrel 18 as determined by the position of the shoulder 41. Thus, the mandrel threads 51 will always be engaged with the internal threads 50 on the fingers 47; but by virtue of the lateral spacing between the heads 48 and the groove 49, the mandrel 18 is free to travel upwardly within the tubular member 44 with only a minimum of restraint as the fingers 47 successively flex inwardly and outwardly.

It should be further noted in FIG. 2B that the elongated fluid passage 43 in the upper housing 21 is also appropriately arranged to be communicated with a similar longitudinal fluid passage 52 in the intermediate housing 22 when these two housing sections are coupled together.

Figure 2C:
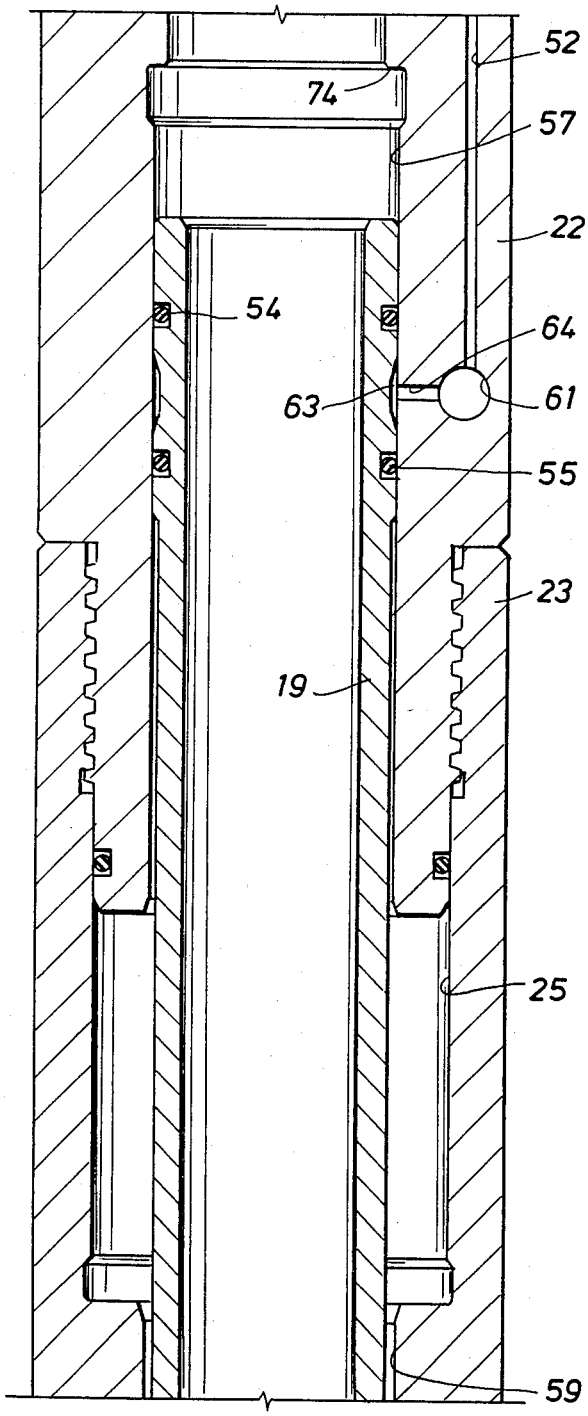
Figure 2D:
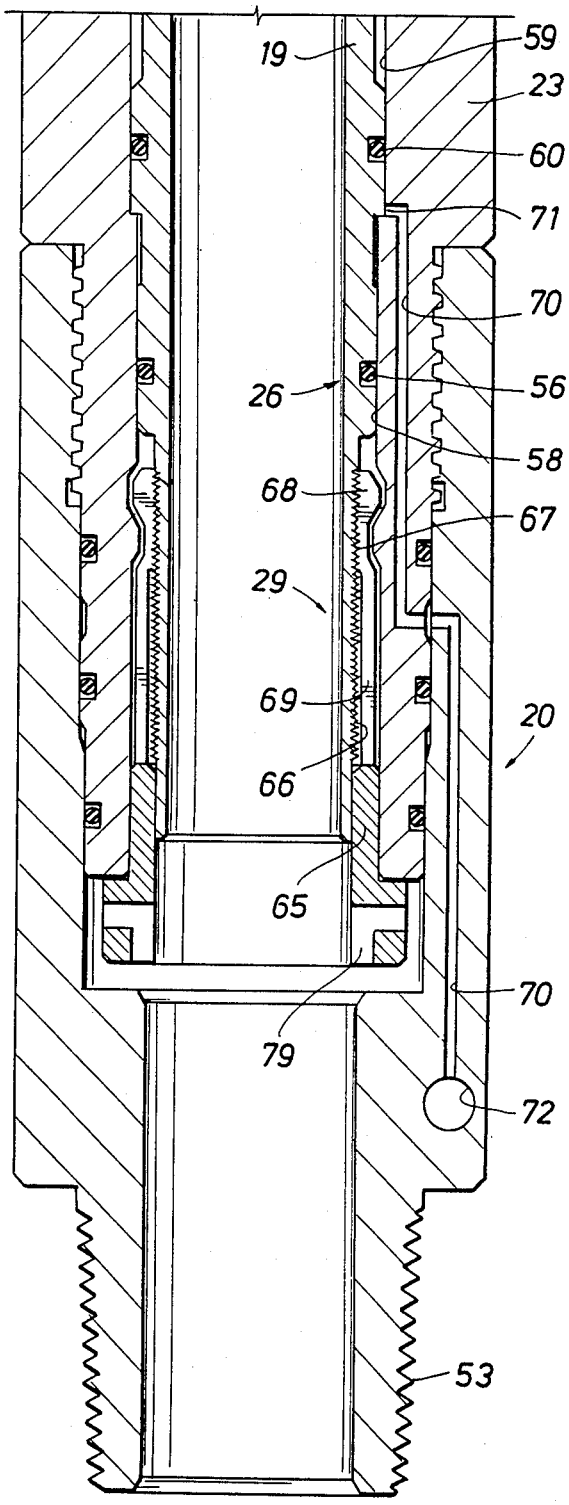

Turning now to FIGS. 2C and 2D, the lower portion of the new and improved sampler 10 of the present invention is seen. The lower end of the lower housing 23 is provided with suitable external threads 53 for coupling the sampler 10 to other tools therebelow. The mandrel 19 is cooperatively sealed in relation to the housing 23 by means such as a spaced pair of O-rings 54 and 55 on the upper end portion of the lower mandrel and a single O-ring 56 on the lower end portion of the lower mandrel, with these three O-rings respectively being engaged with the adjacent wall surfaces of the upper and lower bores 57 and 58 in the lower housing. As will subsequently be explained by reference to FIGS. 3–5, the upper and lower housing bores 57 and 58 are arranged to be of the same internal diameter and are separated by an intermediately-located, enlarged-diameter housing bore 59 which receives the enlarged lower piston 26 carrying an O-ring 60.

The longitudinal passage 52 in the intermediate housing 22 terminates on one side of an enlarged lateral chamber 61 which is conveniently located within the housing wall. As has been schematically represented at 62 in FIGS. 3–5, an orifice such as a so-called "impedance jet" or some other typical flow-impeding device (not itself shown in FIG. 2C) is arranged within this small lateral chamber 61 for selectively metering the flow of oil as it is being transferred from the upper chamber 24 (FIGS. 2A and 2B) into the lower chamber 25 (FIGS. 2C and 2D). An inwardly-facing lateral port 63 in the wall of the upper housing bore 57 terminates a short passage 64 leading from the other side of the chamber 61 containing the flow-retarding device 62; and this port is appropriately located in the upper housing bore 57 so as to be straddled by the spaced O-rings 54 and 55 on the upper end of the mandrel 19 whenever the lower mandrel is in its running-in or initial position.

The lower mandrel-retaining means 29 are cooperatively arranged in the lower housing of the fluid sampler 10 so as to releasably secure the reduced-diameter lower portion of the lower mandrel 19 to the housing 23. Since the upper and lower mandrel-retaining means 28 and 29 are identical, it is necessary only to note that the lower retaining means similarly include a tubular retainer member 65 which is rotatably mounted within the lower housing 23 and releasably coupled to the lower mandrel by means of external threads 66 on the mandrel 19 which are co-engaged with internal threads 67 within the enlarged heads 68 of the collet fingers 69.

It should be noted as well that a longitudinal fluid passage 70 is similarly arranged in the lower housing 23 and terminated by an inwardly-facing lateral port 71 that is situated in the axial bore 58 so as to be always straddled by the spaced O-rings 56 and 60 on the lower and intermediate portions of the lower mandrel 19 regardless of whether the mandrel is in its running-in position or is in its final elevated position. The other end of this passage 70 leads to a small chamber 72 that is conveniently located in the wall of the lower housing 23. As schematically depicted at 73 in FIGS. 3–5, this chamber 72 is appropriately arranged to receive a typical rupture disk assembly (not itself shown in FIG. 2D) that is designed to fail at a predetermined fluid pressure. Hereagain, the function of this rupture disk 73 will subsequently be explained by reference to FIG. 3.

Figure 3:
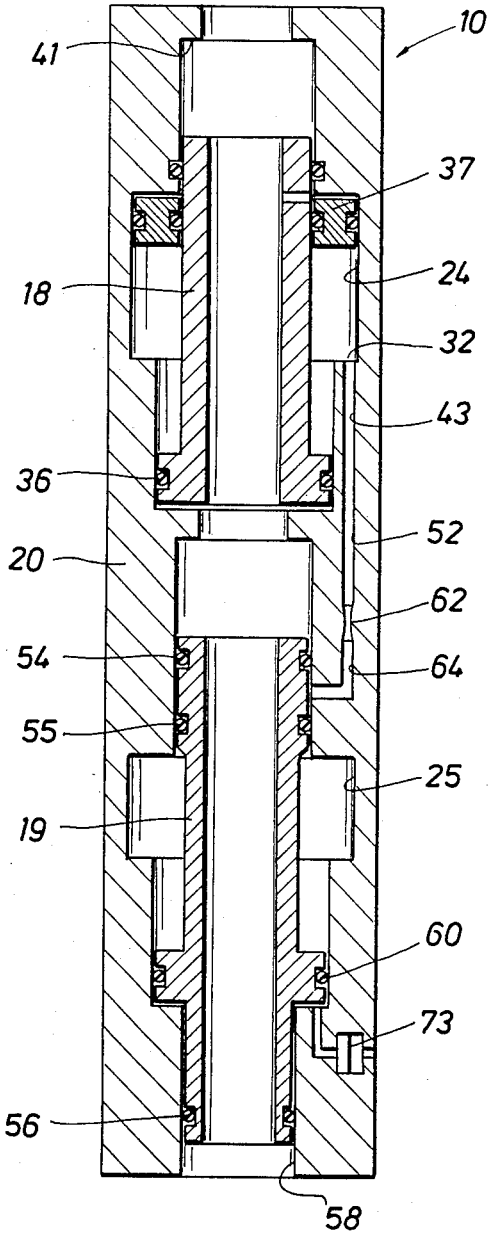
FIGS. 3–5 are somewhat-schematic views of the well tool depicted in FIGS. 2A–2D showing its successive operating positions during the course of a typical sample-collecting operation.
Figure 4:
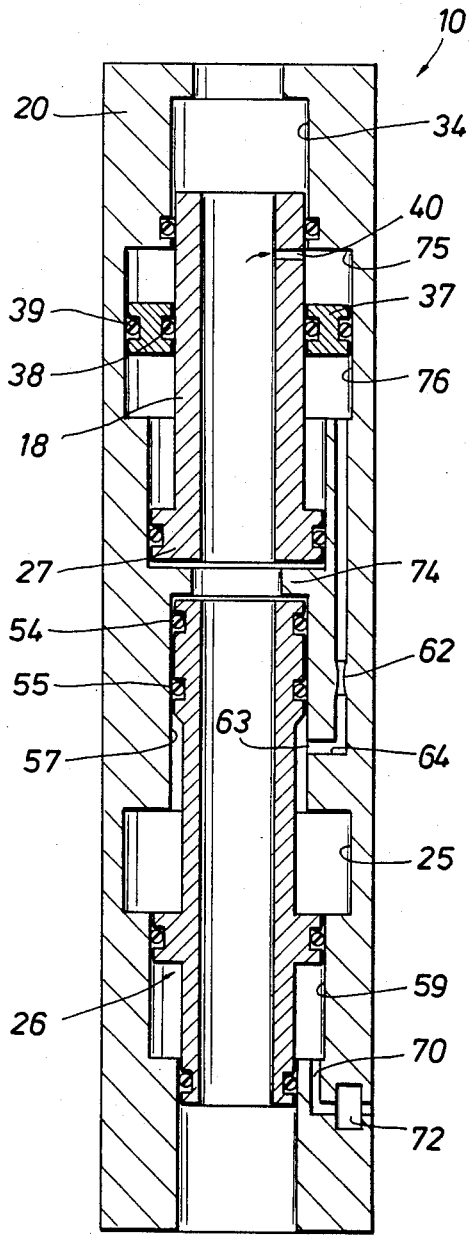
Figure 5:
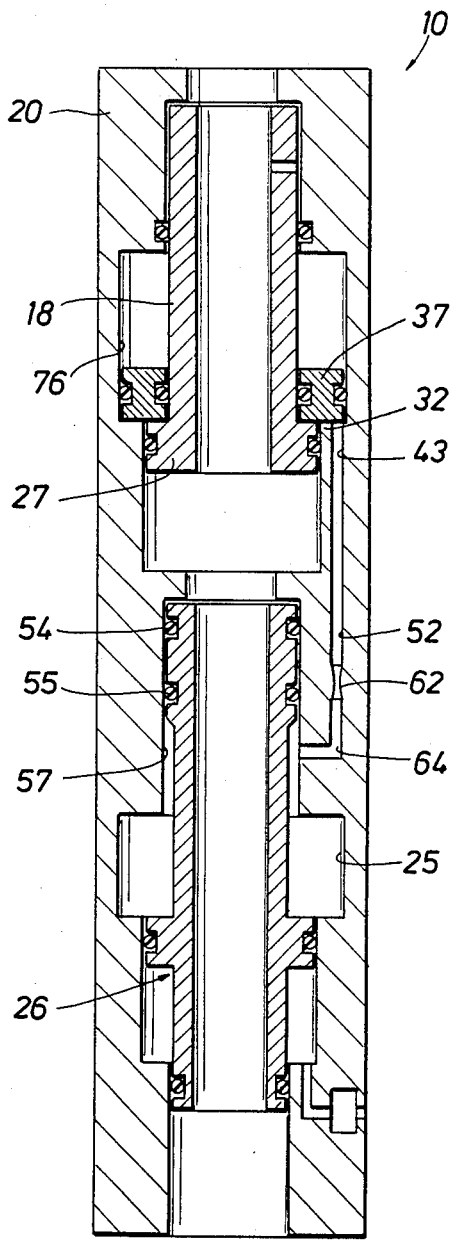

Turning now to FIGS. 3–5, the new and improved sampler 10 is schematically depicted, with these three views respectively illustrating the sampler during successive stages of a typical sample-collecting operation in the cased well bore 17. As was previously noted, the upper and lower retaining means 28 and 29 are effective for releasably securing the upper and lower mandrels 18 and 19 in their respective initial operating positions within the housings 21 and 23 to thereby prevent premature upward movement of the mandrels. However, since the upper and lower mandrel-retaining means 28 and 29 play no particular part in the downhole operation of the tool 10, they have not been shown in FIGS. 3–5.

To prepare the tool 10 at the surface for a subsequent operation, the annular piston 37 is elevated in the upper chamber 24 and the sample chamber below the annular piston as well as the interconnecting fluid passages 43, 52 and 64 and the lateral chamber 61 enclosing the flow-impeding device 62 are respectively filled with oil. The mandrell-retaining means 29 are manually operated as will subsequently be explained to move the lower mandrel 19 to its running-in position. It will be appreciated, therefore, that so long as the lower mandrel 19 remains in its lower or running-in position depicted in FIG. 3, the spaced O-rings 54 and 55 on the upper end of the mandrel 19 cooperate to prevent the escape of this oil from the sample chamber 24 and the interconnecting passages 43, 52 and 64. Thus, since oil is relatively non-compressible, trapping of the oil in the chamber 24 will effectively retain the annular piston 37 in its elevated position within the sample chamber. It should also be noted that since the upper and lower portions of the mandrel 19 respectively carrying the O-rings 54, 55 and 56 are preferably arranged to have equal cross-sectional areas, the lower mandrel is pressure balanced with respect to fluids within the sampler 10. Thus, as the tool 10 is lowered in the well bore 17, the pressure of fluids that may be in the pipe string 16 will not affect the mandrel 19. As previously noted, the mandrel-retaining means 28 and 29 cooperate to prevent the mandrels 18 and 19 from being inadvertently moved by rough handling or impacts.

As previously discussed by reference to FIG. 1, to operate the new and improved sampler 10 of the present invention in a cased well bore, as at 17, the several tools 10–15 supported by the pipe string 16 are positioned at a given depth in the well bore and the packer set to isolate the formation interval of interest from the hydrostatic pressure of the drilling mud above the packer. As is customary, the test tool 12 is then operated as required to communicate the packed-off interval below the packer 11 with the interior of the pipe string 16. Since the internal bore of the pipe string 16 is initially at a lower pressure than the pressure of the connate fluids typically encountered in a formation interval, when the tester 12 is first opened any producible fluids in the isolated interval will flow into the pipe string 16. As previously noted, the pressure gauges in the housing 15 will record the pressure conditions in the isolated interval of the well bore 17 as the tester 12 is successively opened and closed.

At some point in a typical test, it will usually be desired to collect a representative sample of whatever producible fluids that may be present in the pipe string 16. As previously noted, those skilled in the art recognize the importance of securing samples of flowing connate fluids without significantly changing the flow conditions. Thus, in keeping with the objects of the invention, the sampler 10 is cooperatively arranged for trapping a representative sample of formation fluids present therein without unduly disturbing their flow conditions.

To initiate the operation of the sampler 10 in a cased well bore, pumps (not shown) are operated to increase the pressure in the well bore 17 to a pressure level sufficient to selectively cause failure of the rupture disk 73 in the tool housing 20. Those skilled in the art will, of course, recognize that where the tester 12 is also operated by selective pressure increases in the annulus of the well bore 17, the rupture disk 73 must be selected to fail at a higher pressure. Moreover, should a second sampler (not shown in the drawings) in keeping with the principles of the invention also be arranged with the other tools 10–15 for collecting a second fluid sample, the rupture disk used with this second sampler must, of course, be selected to fail at a still-higher pressure to permit the selective prior operation of these other tools.

As will be appreciated by comparison of FIGS. 3 and 4, upon failure of the rupture disk 73, drilling mud in the annulus of the well bore 17 will enter the housing 20 by way of the fluid passage 70. Since the lower chamber 25 is initially empty and thereby contains only air at atmospheric pressure, entrance of the pressured drilling mud into the axial bore 59 below the piston member 26 will be effective for moving the lower mandrel 19 upwardly until it engages the inwardly-directed housing shoulder 74 above the annular chamber 25. It will be recalled that the lower mandrel-retaining means 29 do not unduly restrain upward travel of the lower mandrel 19 since the external mandrel threads 66 (FIG. 2D) will pass freely through the internal threads 67 on the collet heads 68 as the fingers 69 are successively expanded and contracted by the ratcheting action between the co-engaged threads.

Once the mandrel 19 is elevated in response to the previously-described predetermined increase in the annulus pressure, as seen in FIG. 4 the spaced O-rings 54 and 55 on the upper end of the lower mandrel will now be positioned above the lateral port 63 terminating the housing passage 64 thereby communicating it and its associated oil-filled passages 43 and 52 with the still-empty annular chamber 25. It will also be noted from FIGS. 3 and 4 that by virtue of the placement of the normally-open port 40 in the upper mandrel 18, the connate fluids flowing through the sampler 10 during a typical testing operation are always communicated with the upper portion 75 of the sample chamber 24. Nevertheless, so long as oil is trapped in the lower portion 76 of the sample chamber 24, the annular piston 37 cannot move downwardly therein; and, as a result, the formation fluids can not prematurely enter the upper portion 75 of the sample chamber. On the other hand, once the lower mandrel 19 has moved upwardly, the oil trapped in the lower portion 76 of the sample chamber 24 will be displaced (by way of the fluid passages 43, 52 and 64) into the lower chamber 25 as the annular piston 37 is moved downwardly by the formation fluids entering the upper portion 75 of the sample chamber.

Those skilled in the art will, of course, recognize that since the lower chamber 25 is initially at atmospheric pressure, the highly-pressured formation fluids entering the sample chamber 24 will impose a substantial pressure differential across the annular piston 37. Thus, the flow-impeding device or orifice 62 interposed between the oil passages 52 and 64 is appropriately selected in accordance with anticipated formation conditions so as to greatly retard or regulate the displacement of oil from the lower portion 75 of the sample chamber 24 into the lower chamber 25. In keeping with the objects of the present invention, the controlled displacement of oil from the sample chamber 24 provided by the cooperation of the annular piston 37 and the flow-regulating device 62 effectively limits the rate at which the formation fluids enter the sample chamber as needed to greatly minimize disturbances to the formation fluids that would otherwise take place without such flow regulation. It will, of course, be appreciated that once the annular piston 37 reaches the housing shoulder 32 defining the lower end of the sample chamber 24, the chamber will be completely filled with a representative sample of the formation fluids that were produced from the isolated formation interval below the packer 11.

Once it is filled, the sample chamber 24 must, of course, be closed to safeguard and isolate the representative fluid sample. Accordingly, as another aspect of the present invention, the closure of the sample chamber 24 is uniquely accomplished by the mandrel piston 27 which is operable only upon filling of the sample chamber for selectively shifting the upper mandrel 18 upwardly in relation to the housing 20. To accomplish this, it will be recognized from FIG. 4 that so long as the annular piston 37 is moving downwardly in the sample chamber 24, the upper mandrel 18 will be substantially balanced with respect to the pressure of the formation fluids in the isolated portion of the well bore 17. In other words, formation fluids within the axial bore 34 of the sampler 10 will impose an upwardly-directed pressure force on the mandrel piston 27. Simultaneously, so long as there is still some oil remaining in the lower portion 76 of the sample chamber 24, a corresponding downwardly-directed force will be imposed on the mandrel piston 27. Thus, since the pressure of the oil within the lower portion 76 of the sample chamber 24 is equal to the pressure of the formation fluids in the sampler 10, the upper mandrel 18 will remain stationary and will not be shifted relative to the housing 20 so long as the annular piston 37 is still moving downwardly in the oil-filled lower portion of the sample chamber.

Nevertheless, by sizing the chamber 25 to be slightly larger than the lower chamber portion 76, once the piston 37 halts on the shoulder 32, all of the oil that was initially trapped in the sample chamber 24 will have been displaced into the lower chamber and the final pressure therein will be lower than that of the connate fluids. The upwardly-acting pressure forces on the mandrel piston 27 will then be greater than the opposing downwardly-acting forces and these unbalanced pressure forces will be effective for moving the upper mandrel 18 upwardly to its final position in response to the filling of the sample chamber 24. It should be noted that as the mandrel 18 approaches its final position, the piston 37 is shaped to direct the last of the oil into the passage 43.

As previously noted, the new and improved sampler 10 is equally suited for collecting fluid samples in cased well bores as well as in uncased boreholes. Nevertheless, it is not always advisable to employ pressure-responsive means (such as the rupture disk 73) for selectively actuating the sampler 10 since there are situations in which substantial increases in the well annulus pressure can damage liners in a cased well or seriously damage one or more formations penetrated by an uncased borehole. Accordingly, to provide an alternative mode for selectively actuating the sampler 10 from the surface, the new and improved sampler is instead coupled to a typical full-bore valve assembly that is operated by manipulating the pipe string from admitting either drilling mud or a pressured oil into the lower housing 23. In such situations, the associated tools, as at 11–15, may also have to be replaced by other types of these tools. For instance, the pressure-controlled tester 12 may have to be replaced with a typical drillstem tester that is also controlled by selectively manipulating the pipe string. A typical full-bore drillstem tester of this type as well as other full-bore tools which could also be effectively used with these alternative arrangements of the new and improved sampler 10 are fully disclosed in U.S. Pat. Nos. 3,308,887 and 3,662,826.

One manner of modifying the new and improved sampler 10 for use with such a valve assembly is to remove the threaded end piece of the lower housing 23 and couple the exposed housing threads to the tubular mandrel of the valve assembly which is telescopically disposed within the outer housing of the assembly and adapted for longitudinal movement therein between an initial extended position and a final telescoped position whenever the weight of the pipe string is slacked-off. In the simplest form of this valve assembly, a longitudinal passage is appropriately arranged in the mandrel to take the place of the passage 70 in the threaded end piece. The upper end of this substitute passage is communicated with the housing bore 59 in the sampler 10 in the same manner as the passage 70. The passage is, however, terminated at its lower end with a lateral port that is cooperatively associated with spaced O-rings for closing the port when the members of the valve assembly are extended and for opening the port when these members are telescoped relative to one another. This arrangement of the port and its associated O-rings is, of course, similar to the cooperative arrangement of the O-rings 54 and 55 and the lateral port 63. With this simple valve assembly, the opening of the lateral port will simply admit drilling mud from the well annulus into the substitute passage in the same manner as when the rupture disk 73 is failed.

A slightly-modified version oft he above-described valve assembly is arranged so that longitudinal movement of the mandrel to open the lateral port will instead communicate the substitute passage with an oil-filled annular chamber in the housing. In this latter arrangement, a movable annular piston separates the oil-filled portion of the chamber from a mud-filled portion of the chamber which is communicated with the well bore annulus. To increase the pressure in the oil-filled chamber, a piston is arranged on the mandrel to be moved into the oil-filled chamber for displacing oil therefrom into the substitute passage as the mandrel of the valve assembly is moved downwardly in relation to the housing of the assembly. If deemed necessary, the admission of the pressured oil into the housing bore 59 of the sampler 10 can be selectively regulated by further arranging one or more typical control devices such as a pressure-responsive valve and a flow-restricting device in the oil passage between the housing bore 59 and the oil-filled portion of the chamber. It will, of course, be appreciated that by arranging this typical pressure-responsive valve to open only upon a predetermined pressure increase in the oil passage, this modified embodiment of the sampler 10 will be selectively actuated from the surface only when the tubing string 16 is slacked-off sufficiently to impose a predetermined weight on the mandrel of the valve assembly. Also, with this typical flow-impeding device conveniently located in the oil passage, this modified valve assembly will adequately protect this alternative embodiment of the sampler 10 against inadvertent or premature actuation.

Regardless of which of the two above-described sample-collecting tools of the present invention are used, it will be appreciated that once a fluid sample has entered the upper portion 75 of the sample chamber 24 and the upper mandrel 18 has been shifted upwardly in response to the filling of the sample chamber, the sample will remain trapped therein until the sampler 10 is returned to the surface. It should also be noted that by virtue of the full-diameter axial bores in the upper and lower mandrels 18 and 19, there is unobstructed access between the surface and the tools below the sampler 10 even when the sample chamber 24 is closed.

In any event, once the testing operation is completed, the packer 11 is actuated as needed to retract its packing element and the string of tools 10–15 is returned to the surface by successively disconnecting one or more joints of the pipe string 16 and raising the remaining joints until all are at the surface.

Once the tool 10 is at the surface, it will be appreciated that the modular arrangement of the body 20 will permit the upper housing 21 to be readily disconnected from the other housing sections 22 and 23. If desired, the threaded end piece of the lower housing 23 can be removed. Similarly, if the above-described alternative arrangement of the new and improved sampler 10 has been used, the typical valve assembly that was used in place of the threaded end piece can also be removed from the lower housing 23. In either case, this disassembly will leave the upper and lower mandrel-retaining means 28 and 29 respectively accessible.

It should be particularly noted that if desired to transport the collected sample to a distant laboratory for examination, the disassembled housing section 21 is relatively light and convenient to handle as well as completely safe to transport. To remove a sample from the sample chamber 24, a supply of pressured water is connected by way of a special fixture (not illustrated) to the fluid passage 43. A plug 77 in the outer end of the passage 42 is removed and another special fixture (not shown) is similarly connected to the passage 43 for conducting the fluid sample to a suitable container. Thus, by admitting pressured water into the lower portion 76 of the sample chamber 24, the sample of formation fluids in the upper portion 75 of the chamber will be completely displaced therefrom as the annular piston 37 is moved upwardly in the chamber. Those skilled in the art will, of course, recognize that the floating piston 37 makes it wholly unnecessary to utilize mercury for displacing a fluid sample from the chamber 24.

To return the mandrels 18 and 19 to their initial positions as shown in FIGS. 2A–2D, the mandrel-retaining means 28 and 29 are respectively arranged to permit the mandrels to be manually returned to these initial positions. By engaging a suitable hand tool (not illustrated) in the slots 78 or 79 in the enlarged heads of the tubular members 45 and 65, an operator can manually rotate these members as needed to return them to their initial positions. For instance, with the upper retaining-means 28, rotation of the member 45 will be effective for carrying the mandrel 18 back to its original position as the mandrel threads 51 are progressively engaged by the threads 50 on the enlarged collet heads 48. In a similar fashion, rotation of the lower retaining member 65 is employed for returning the lower mandrel 19 to its original position.

Accordingly, it will be appreciated that the new and improved sampler of the present invention has provided a full-bore sample-collecting tool which can be selectively operated in various manners from the surface for collecting representative samples of formation fluids that may be produced during a typical drillstem testing operation. In particular, the new and improved sample-collecting tool described herein is particularly suited for use either in cased well bores or in uncased boreholes since its unique design permits the tool to be selectively actuated from the surface without risking damage to the well bore or earth formations. Moreover, by arranging the sampler of the present invention as described, the samples of formation fluids obtained will be safely trapped only in response to closing of the sample chamber thereby permitting the sampler to be returned to the surface and the sample may be safely removed for subsequent examination.

While a particular embodiment of the present invention has been shown and described, it is apparent that changes and modifications can be made without departing from this invention in its broader aspects; and, therefore, the aim in the appended claims is to cover all such changes and modifications as fall within the true spirit and scope of this invention.

What is claimed is:

1. A well tool adapted to be connected in a pipe string and positioned in a well bore for collecting a sample of connate fluids flowing inside of the pipe string and comprising:

inner and outer tubular members telescopically arranged together for longitudinal movement of said inner member between spaced first and second positions and cooperatively defining an annular sample chamber therebetween adapted to receive a fluid sample when said inner member is in its said first position and adapted to trap that sample therein when said inner member is in its said second position;

first means selectively operable from the surface for admitting a fluid sample into said sample chamber when said inner member is in its said first position;

second means operable only upon admission of a fluid sample into said sample chamber for regulating the rate at which that sample fills said sample chamber; and third means operable only upon filling of said sample chamber with a fluid sample for moving said inner member to its said second position to trap that sample in said sample chamber.

2. The well tool of claim 1 wherein said first means include means responsive to a surface-controlled increase in the well bore pressure.

3. The well tool of claim 1 wherein said second means include means responsive to the pressure of a fluid sample entering said sample chamber.

4. The well tool of claim 1 wherein said first means include means operated in response to a surface-controlled increase in the well bore pressure; and said second means include means operated in response to the pressure of a fluid sample entering said sample chamber.

5. A well tool as in any one of claims 1–4 in which said third means are operated in response to the pressure of a fluid sample in said sample chamber.

6. A well tool adapted to be connected in a pipe string and positioned in a well bore for collecting a sample of connate fluids flowing inside of the pipe string and comprising:

first and second inner tubular members telescopically arranged within an outer tubular member and independently movable therein between respective first and second spaced operating positions;

sample-collecting means including first and second spaced seal means cooperatively arranged between said tubular members for defining first and second annular fluid chambers between said outer member and said first and second members respectively, piston means movably arranged in said first chamber for dividing said first chamber into one isolated portion adapted to receive a fluid sample and another isolated portion adapted to contain a non-compressible fluid, passage means communicating said other isolated chamber portion with said second chamber, means adapted for communicating the internal bores of said inner members with said one isolated chamber portion when said first member is in its said first position and adapted for closing communication therewith when said first member is in its said second position, and means adapted for closing communication of said passage means with said second chamber when said second member is in its said first position and adapted for opening communication therewith when said second member is in its said second position;

first means selectively operable from the surface for moving said second member from its said first position to its said second position for opening communication between said passage means and said second chamber to initiate movement of said piston means to displace a non-compressible fluid out of said other isolated chamber portion and through said passage means into said second chamber as a fluid sample is admitted into said one isolated chamber portion;

second means operable only upon admission of a fluid sample into said one isolated chamber portion for regulating the rate at which that sample fills said one isolated chamber portion and including flow-restricting means cooperatively arranged in said passage means for metering the flow of a non-compressible fluid being displaced from said other isolated chamber portion by the movement of said piston means as that sample fills said one isolated chamber portion; and third means operable only upon filling of said one isolated chamber portion with a fluid sample for moving said first member to its said second position to trap that sample in said one isolated chamber portion.

7. The well tool of claim 6 wherein said first means include means responsive to a surface-controlled increase in the well bore pressure.

8. The well tool of claim 6 wherein said first means include means defining an enclosed piston chamber between said outer member and said second member, piston-actuating means on said second member and cooperatively arranged for movement within said piston chamber and adapted for moving said second member from its said first position to its said second position upon admission of fluids from the well bore exterior of said well tool into said piston chamber.

9. The well tool of claim 6 wherein said third means include piston-actuating means on said first member and cooperatively arranged for movement within said other isolated chamber portion toward said piston means for moving said first member from its said first position to its said second position once said one isolated chamber portion has been filled with a fluid sample for displacing a non-compressible fluid from said other isolated chamber portion to reduce the pressure therein between said piston means and said piston-actuating means below the pressure in said one isolated chamber portion.

10. A well tool adapted to be connected in a pipe string and positioned in a well bore for collecting a sample of connate fluids flowing in that pipe string and comprising:

a tubular housing member;

sample-collecting means including a first tubular member telescopically arranged within said housing for longitudinal movement therein between spaced first and second positions and cooperatively defining an annular sample chamber therebetween, means adapted for admitting connate fluids flowing within the internal bores of said tubular members into said sample chamber when said first member is in its said first position, and means adapted for trapping a sample of such fluids in said sample chamber when said first member is in its said second position;

means operable for controlling the admission of connate fluids into said sample chamber including piston means movably arranged in said sample chamber and dividing said sample chamber into a first isolated portion adapted to receive a sample of such fluids and a second isolated portion adapted to initially contain a non-compressible fluid, a second tubular member telescopically arranged within said housing for longitudinal movement therein between spaced first and second positions and cooperatively defining a second annular chamber therebetween, passage means in said housing intercommunicating said second isolated chamber portion with said second chamber, means adapted for initially closing said passage means to temporarily trap a non-compressible fluid in said second isolated chamber portion means and leave said second chamber empty when said second member is in its said first position and adapted for subsequently opening said passage means to allow that non-compressible fluid to enter said second chamber when said second member is in its said second position;

first means selectively operable from the surface for moving said second member to its said second position so that said piston means can thereafter displace a non-compressible fluid initially trapped in said second isolated chamber portion into said second chamber upon admission of connate fluids into said first isolated chamber portion;

second means for regulating the rate at which connate fluids are admitted into said first isolated chamber portion including flow-restricting means in said passage means adapted to meter the flow of a non-compressible fluid into said second chamber; and third means operable only upon filling of said first isolated chamber portion with connate fluids for moving said first member to its said second position to trap those fluids therein.

11. The well tool of claim 10 in which said first means include means responsive to a surface-controlled increase in the well bore pressure.

12. The well tool of claim 10 in which said third means include means on said first member operable in response to the pressure differential between a non-compressible fluid in said second chamber and connate fluids flowing within the internal bores of said tubular members.

13. The well tool of claim 10 wherein said first means include means defining an enclosed piston chamber between said housing and said second member, piston-actuating means on said second member and cooperatively arranged for movement within said piston chamber and adapted for moving said second member from its said first position to its said second position upon admission of fluids from the well bore exterior of said well tool into said piston chamber.

14. The well tool of claim 10 wherein said third means include piston-actuating means on said first member and cooperatively arranged for movement within said second isolated chamber portion toward said piston means for moving said first member from its said first position to its said second position once said first isolated chamber portion has been filled with connate fluids for displacing a non-compressible fluid from said second isolated chamber portion to reduce the pressure therein between said piston means and said piston-actuating means below the pressure in said first isolated chamber portion.

15. Well bore apparatus adapted for collecting a sample of connate fluids from earth formations penetrated by a well bore and comprising:

a pipe string positioned in said well bore;

a well packer coupled to said pipe string and including means selectively operable from the surface for packing-off said well bore to isolate a lower interval of the well bore which is in fluid communication with an earth formation containing connate fluids from well bore fluids in the well bore thereabove;

valve means cooperatively arranged between said pipe string and said well packer and including means selectively operable from the surface for controlling fluid communication between said pipe string and said isolated lower well bore interval; and sample-collecting means having an annular sample chamber cooperatively arranged between said pipe string and said well packer and including first means selectively operable from the surface for admitting a sample of connate fluids produced upon opening of said valve means into said sample chamber, second means operable only upon admission of a sample of connate fluids into said sample chamber for regulating the rate at which that sample fills said sample chamber, and third means operable only upon filling of said sample chamber for trapping that sample in said sample chamber.

16. The well bore apparatus of claim 15 wherein said valve means are selectively operable in response to a surface-controlled increase in the pressure of the well bore fluids to a first predetermined level for admitting connate fluids into said pipe string; and said first means are selectively operable in response to a subsequent surface-controlled increase in the pressure of the well bore fluids to a second predetermined level greater than said first predetermined pressure for admitting connate fluids flowing in said pipe string into said sample chamber.

* * * * *